US007480470B2

(12) United States Patent
Ai

(10) Patent No.: US 7,480,470 B2
(45) Date of Patent: Jan. 20, 2009

(54) IMAGE FORMING APPARATUS INCLUDING A REMOVING MEMBER FOR REMOVING TONER FROM A TONER COLLECTING MEMBER

(75) Inventor: Ryuta Ai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 11/470,853

(22) Filed: Sep. 7, 2006

(65) Prior Publication Data

US 2007/0059007 A1 Mar. 15, 2007

(30) Foreign Application Priority Data

Sep. 13, 2005 (JP) ..... 2005-266124

(51) Int. Cl.
*G03G 15/16* (2006.01)

(52) U.S. Cl. ..... 399/101

(58) Field of Classification Search ..... 399/49, 399/101

See application file for complete search history.

(56) References Cited

U.S. PATENT DOCUMENTS 6,175,711 B1 1/2001 Yoshino et al. ..... 399/297
6,181,892 B1 1/2001 Fujimori ..... 399/72
6,970,666 B2 * 11/2005 Takahashi et al. ..... 399/101
7,127,191 B2 * 10/2006 Mori et al. ..... 399/101

FOREIGN PATENT DOCUMENTS

| | | |
|---|---|---|
| JP | 06-138760 | 5/1994 |
| JP | 09-305039 | 11/1997 |
| JP | 11-119478 | 4/1999 |
| JP | 2000-147861 | 5/2000 |
| JP | 2000-187405 | 7/2000 |
| JP | 2002-229344 | 8/2002 |

* cited by examiner

*Primary Examiner*—Sandra L Brase
(74) *Attorney, Agent, or Firm*—Fitzpatrick, Cella, Harper & Scinto

(57) ABSTRACT

The image forming apparatus has an image bearing member, a detecting member, a toner image forming apparatus, a transfer member and a collecting member for collecting toner of a toner image for detection attached to the transfer member rotating while contacting with the transfer member, and removing member for removing the toner collected into said collecting member from the collecting member in a removing area. In the image forming apparatus, a portion of the collecting member contacts the transfer member passes through the removing area by a time when said collecting member next contacts with the transfer member, and by a time when a portion of the collecting member which contacts a portion of the transfer member contacts the toner image for detection next contacts the portion of the transfer member contacts with the toner image for detection, said collecting member passes through the removing area at least two times.

8 Claims, 4 Drawing Sheets

IMAGE FORMING APPARATUS INCLUDING A REMOVING MEMBER FOR REMOVING TONER FROM A TONER COLLECTING MEMBER

BACKGROUND OF THE INVENTION

1. Field of the Invention

The present invention relates to an image forming apparatus such as a copying machine or printer using an electrophotographic mode or electrostatic recording mode. More particularly, the present invention relates to an image forming apparatus for forming a toner image for control in an inter-transfer-material area serving as an area on an intermediate transfer member between toner images to be transferred to a transfer member.

2. Description of the Related Art

In recent years, a technique corresponding to high image quality close to photographic quality or corresponding to high speed close to a printer is requested for an image forming apparatus using an electrophotographic image forming process. To achieve high speed and high image quality, maintenance of color stability and concentration uniformity becomes a problem. Therefore, a technique is widely used which forms a control image constituted of toner (toner image for control), detects the reflection concentration of the image, returns the reflection concentration to an image forming process condition and maintains a stable image.

The above control image is formed at the timing (sheet) corresponding to the portion between a transfer member for currently continuously forming an image for a plurality of transfer members and a transfer member. Therefore, it is necessary to remove (clean) the control image by cleaning means so that the image does not normally attach to an image forming object according to image formation.

To clean a control image from a photoconductor on which an image is directly formed or the surface of an image bearing member such as an intermediate transfer member, the following method is used. That is, the polarity of transfer bias is reversed to normal polarity when an image is formed by a transfer portion to the intermediate transfer member of an image or transfer portion to a transfer member. Thereby, it is possible to clean the control image by a cleaning member provided to clean each image bearing member without transferring a control image from an image bearing member such as a sensitive member or intermediate transfer member.

However, not to transfer a control image formed on a sheet in the flow to recent high-speed technique, it is very difficult to apply a bias having a polarity reverse to the normal polarity when forming an image in view of time and sheet distance.

When it is difficult to apply a reverse bias, a control image is transferred onto an intermediate transfer member from a photoconductor and moreover transferred from the intermediate transfer member to a secondary transfer member in intermediate-transfer-mode image formation. Therefore, when there is not a cleaning member for the secondary transfer member, a defective image due to back contamination or imperfect conveyance of a transfer member has been caused due to the contamination of the secondary transfer member.

Therefore, a member for cleaning a control image to be transferred to the secondary transfer member is necessary. As a cleaning member for the secondary transfer member, a blade mode having a high cleaning capacity is widely used in general. It is general that the secondary transfer member uses a member in which the traveling performance of a blade is stabilized by applying fluorine coating to the surface layer of the blade so that the cleaning capacity of the secondary transfer member is improved by the blade mode.

However, the secondary transfer member also frequently uses a member whose surface layer is roughened from the viewpoint of the conveying performance of a transfer member. In this case, it is possible to clean low-concentration toner attaching to a non-image portion in a developing step, for example, development-fogged toner even by the blade mode. However, to completely clean a high-concentration image such as a control image, it is necessary to increase a linear load at the nip portion between a secondary transfer member and a blade by increasing the contact pressure or contact angle of the blade. However, because the secondary transfer member and the cleaning blade are elastic bodies, frictional force is large. Therefore, when increasing the linear load at the nip portion between the secondary transfer member and the blade, there is a problem that toner is attached and burrs formed on the cleaning blade easily occur.

Japanese Patent Application Laid-Open No. 2002-229344 discloses an electrostatic cleaning mode for electrostatically removing the toner on an intermediate transfer member as a method for cleaning the toner left on an intermediate transfer member after a secondary transfer step. That is, the intermediate transfer member is rotated by bringing a conductive fur brush into contact with the intermediate transfer member. Then, a voltage applying member such as a metallic roller to which a voltage is applied is brought into contact with the conductive fur brush. Thereby, cleaning is performed by electrostatically adsorbing the toner on the intermediate transfer member (electrostatic fur-brush cleaning).

Japanese Patent Application Laid-Open No. 2000-187405 discloses a method for rumpling a toner image attached to a secondary transfer member by bringing a fur brush into contact with the secondary transfer member and rotating it.

Therefore, to clean a secondary transfer member whose surface layer is roughened, it is considered to use electrostatic fur-brush cleaning in which the number of restrictions on the surface shape of a member to be cleaned is small compared to the case of the blade mode.

Moreover, in the case of the electrostatic fur-brush cleaning, a bias having a polarity reverse to the polarity of toner is applied to a conductive fur brush through a voltage applying member such as a metallic roller. Then, by transferring the toner to the fur brush, cleaning is performed. In the case of this electrostatic fur-brush cleaning, even for a secondary transfer member whose surface layer is roughened, the front end of the fur brush enters up to a portion in which the surface of the secondary transfer member is roughened. Therefore, there is an advantage that it is possible to preferably perform cleaning.

However, as a result of studying cleaning of a secondary transfer member according to electrostatic fur-brush cleaning, it is found that there is the following problem.

To stabilize an image, the frequency for forming a control image represented by an image for concentration control may be increased by forming the control image every sheet. Moreover, to improve a read accuracy by a sensor, a control image having an area as large as possible may be formed. In this case, it is difficult to frequently clean high-concentration toner through electrostatic fur-brush cleaning and toner may clog in the fur of the fur brush. Thereby, the function of the fur brush cannot be sufficiently demonstrated and imperfect cleaning causing back contamination of a transfer member or image defect may occur at the time of both-side printing.

That is, in this case, when removing a toner image to be repeatedly transferred to a secondary transfer member at a predetermined cycle by a fur brush rotating by contacting with the secondary transfer member, a portion removing the toner image from the fur brush removes the toner image from the secondary transfer member again at the next rotation. Therefore, it is considered that removal of the toner transferred to the secondary transfer member is not preferably performed.

In this case, to improve the cleaning property by electrostatic fur-brush cleaning, a fur brush may be rotated at a high speed. However, it is difficult to rotate an electrostatic fur brush at a high speed because there are many restrictions on space and cost since a toner suction apparatus is separately required due to a problem of toner fly. Therefore, it is preferable that the peripheral speed ratio between a secondary transfer apparatus and a fur brush becomes 1 or less.

By increasing a fur brush in diameter, it is considered to increase the contact area with a member to be cleaned and improve the cleaning property. However, a large diameter is difficult because of mechanical space.

SUMMARY OF THE INVENTION

An object of the present invention is to provide an image forming apparatus capable of improving the cleaning property of a secondary transfer member when a toner image for control is repeatedly formed in a plurality of inter-transfer-member areas at a predetermined interval.

Another object of the present invention is to provide an image forming apparatus including an image bearing member, a toner image forming member for forming a toner image on said image bearing member, a detecting member for detecting a toner image for detection formed on said image bearing member, a control member for variably controlling image forming conditions of a toner image of the toner image forming member based on detection results for the toner image for detection detected by the detecting member, a transfer member for transferring the toner image on said image bearing member to a recording member while rotating, and contacting the toner image for detection detected by the detecting member, a collecting member for rotating while contacting with the transfer member and collecting toner of the toner image for detection adhered to the transfer member and removing member for removing the toner collected into the collecting member from the collecting member in a removing area, wherein a portion of the collecting member contacts the transfer member passes through the removing area by a time when said collecting member next contacts with the transfer member.

In this case, the collecting member passes through the removing area at least two times by the time when a portion of the collecting member which contacts a portion of the transfer member contacts the toner image for detection next contacts the portion of the transfer member contacts with the toner image for detection.

A further object of the present invention will become apparent by referring to the attached drawings and specification.

DESCRIPTION OF THE EMBODIMENTS

First Embodiment

General Structure of Image Forming Apparatus

Figure 1:
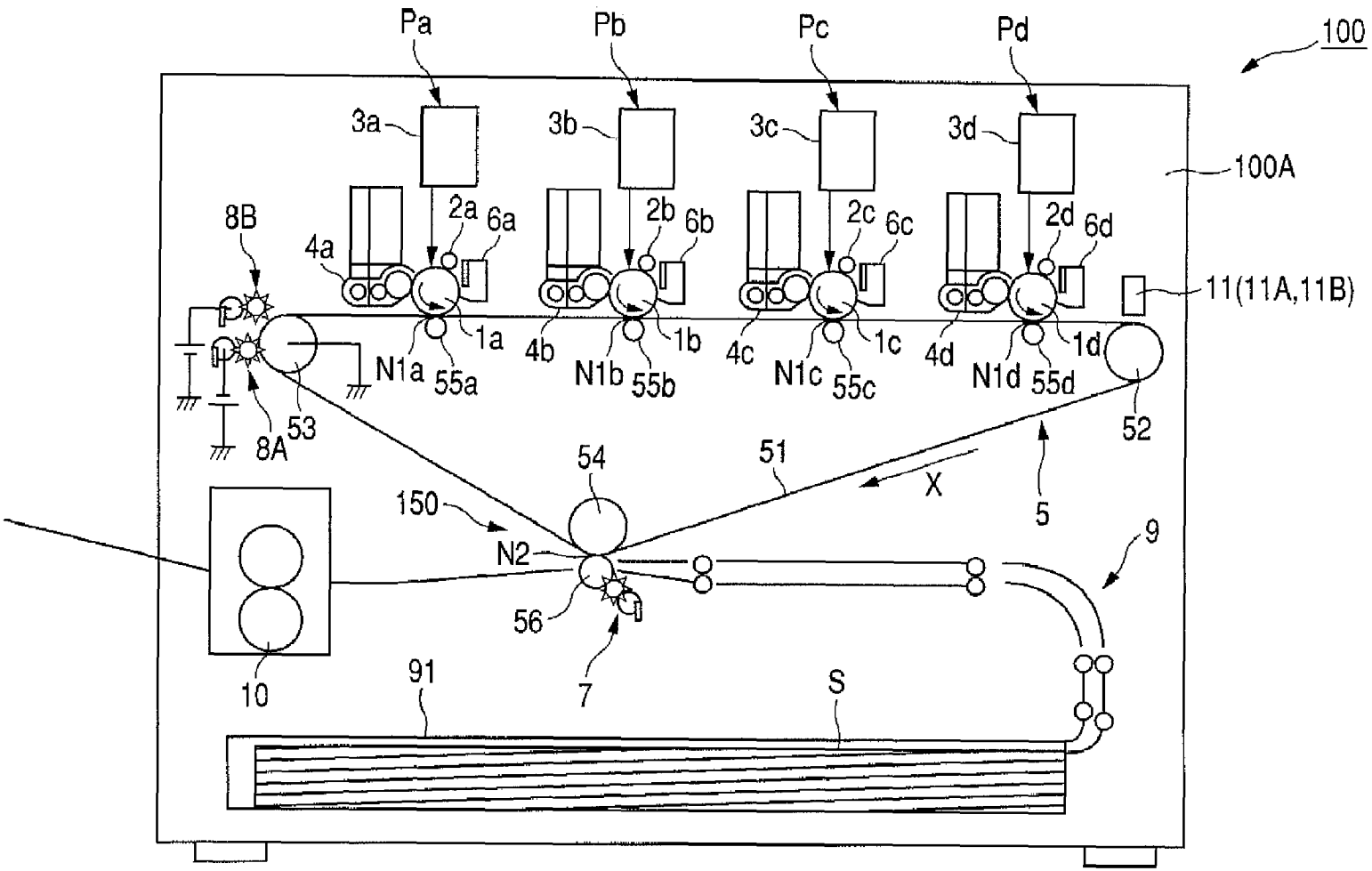
FIG. 1 is a schematic sectional view of an embodiment of an image forming apparatus of the present invention.

FIG. 1 shows a schematic sectional configuration of an embodiment of an image forming apparatus of the present invention. The image forming apparatus 100 of this embodiment is a full color printer capable of forming a full color image on a transfer member (recording sheet or OHP sheet) in accordance with an electrophotographic mode correspondingly to an image signal. The image signal is transmitted to an apparatus body 100A from an external unit such as a personal computer, image reader, or digital camera communicably connected to the image forming apparatus body (apparatus body) 100A.

The image forming apparatus 100 of this embodiment is a tandem-mode image forming apparatus. That is, the image forming apparatus 100 is provided with an intermediate transfer belt 51 formed of an endless elastic belt serving as an intermediate transfer member. The intermediate transfer belt 51 is an image bearing member (second image bearing member) for bearing a toner image. The intermediate transfer belt 51 is hanged on a driving roller 52, tension roller 53, and backup roller 54 as a support medium. Four image forming portions (first, second, third and fourth image forming portions) serving as toner image forming means for forming toner images Pa, Pb, Pc and Pd are arranged in series along the horizontal portion of the intermediate transfer belt 51.

In the case of this embodiment, configurations of image forming portions Pa, Pb, Pc and Pd are the same except for the colors of the toners to be used. Therefore, when differentiation is not necessary, suffixes a, b, c and d attached to show a factor provided for any color are omitted and description is generally performed.

The image forming portion P is provided with a drum-like electrophotographic sensitive member (hereafter referred to as "photoconductor drum") 1 serving as a first image bearing member. The photoconductor drum 1 is rotated in the direction of the arrow in FIG. 1. Process units such as charging 2 roller serving as primary charging means, exposure means 3 serving as exposing means, development counter 4 serving as development means and cleaner 6 serving as cleaning means are arranged around the photoconductor drum 1. Image forming portions Pa to Pd form yellow, magenta, cyan and black toner images. That is, two-component developers provided with yellow (Y), magenta (M), cyan (C) and black (Bk) are housed in development counters 4*a* to 4*d* arranged on the image forming portions Pa to Pd.

An intermediate transfer unit 5 having the above intermediate transfer belt 51 is set by facing photoconductor drums 1*a* to 1*d* of the image forming portions Pa to Pd. The intermediate transfer belt 51 goes around (rotates) in the direction of the arrow in FIG. 1 when a driving force is transferred to the driving roller 52. Then, a primary transfer roller (primary transfer member) 55 constituting primary transfer means is set to a position facing photoconductor drums 1*a* to 1*d* of the image forming portions Pa to Pd at the inner-periphery side of the intermediate transfer belt 51. When primary transfer rollers 55*a* to 55*d* press the intermediate transfer belt 51 against photoconductor drums 1*a* to 1*d*, primary transfer portions (primary transfer nips) N1*a* to N1*d* in which the intermediate transfer belt 51 contacts with the photoconductor drum 1 are formed. Moreover, a secondary transfer roller 56 serving as a secondary transfer member is set to a position facing the backup roller 54 through the intermediate transfer belt 51. The intermediate transfer belt 51 is held by the backup roller 54 and secondary transfer roller 56. Thereby, a secondary transfer portion (secondary transfer nip) N2 where the intermediate transfer belt 51 contacts with the secondary transfer roller 56 is formed.

The photoconductor drum 1*a* is first uniformly charged by a charging roller 2*a* at the first image forming portion Pa when forming a full color image. Light corresponding to an image signal for yellow component color of an original is projected through a polygon mirror from exposure means 3*a* on the charged photoconductor drum 1*a*. Thereby, an electrostatic image (latent image) corresponding to a yellow-component-color image signal is formed on the photoconductor drum 1*a*. Then, the electrostatic image on the photoconductor drum 1*a* is developed as a yellow toner image because yellow toner is supplied from the development counter 4*a*. When this toner image reaches the primary transfer portion N1*a*, in accordance with rotation of the photoconductor drum 1*a*, it is transferred to the intermediate transfer belt 51 by the primary transfer roller 55*a*. In this case, a predetermined primary transfer bias having a polarity reverse to the normal charging polarity of toner is applied from a primary transfer-bias power supply to the primary transfer roller 55*a*.

The intermediate transfer belt 51 bearing a yellow toner image is conveyed to the next secondary image forming portion Pb. A magenta toner image is formed on the photoconductor drum 1*b* in accordance with the same method as the above at the second image forming portion Pb by this time. The magenta toner image is superimposed on the yellow toner image on the intermediate transfer belt 51 and transferred in accordance with the same method as the above at the primary transfer portion N1*b*.

Similarly, as the intermediate transfer belt 51 is progressed to third and fourth image forming positions Pc and Pd, a cyan toner image and black toner image are superimposed on and transferred to a toner image on the intermediate transfer belt 51 at the primary transfer portions N1*c*, N1*d*.

A transfer member S is sent out from the cassette 91 of a transfer member supply portion 9 and supplied to the secondary transfer portion N2 at the same timing as a toner image on the intermediate transfer belt 51.

Toner images of four colors on the intermediate transfer belt are transferred onto the transfer member S (secondary transfer) by an electric field formed between the backup roller 54 and the secondary transfer roller 56 at the secondary transfer portion N2. In this case, by applying bias to either or both of the backup roller 54 and secondary transfer roller 56, it is possible to form an electric field between these rollers. In the case of this embodiment, secondary transfer bias having a polarity which is the same as the normal charging polarity of toner is applied from a secondary transfer-bias power supply at the time of a secondary transfer step. When applying the secondary transfer bias to the secondary transfer roller 56, it is allowed to apply bias having a polarity reverse to the normal charging polarity of toner.

Then, the transfer member S to which a toner image is transferred is conveyed to a fixing portion 10. In the fixing portion 10, the toner image is fixed onto the transfer member S by heat and pressure.

The transfer-residue toner on the photoconductor drum 1 which cannot be completely transferred in the primary transfer step is cleaned by the cleaner 6 and supplied to the subsequent image forming step. Moreover, transfer-residue toner on the intermediate transfer belt 51 which cannot be completely transferred in the secondary transfer step is cleaned by a first belt cleaner 8A and second belt cleaner 8B serving as belt cleaning means and supplied to the subsequent image forming step. In the case of this embodiment, the first and second belt cleaners 8A and 8B clean the intermediate transfer belt 51 through electrostatic fur-brush cleaning. Biases having reverse polarities to each other are applied to the first and second belt cleaners 8A and 8B.

Moreover, the image forming apparatus 100 can form an image of a desired color such as a black single-color image by using only a desired image forming portion. In this case, the image forming step which is the same as the above is applied in only a desired image forming portion to form only a toner image of a desired color on the intermediate transfer belt 51. Then, the toner image is transferred to the transfer member S and fixed.

In this case, configurations of various portions of the image forming portion P are more specifically described below.

The photoconductor drum 1 is constituted by applying an organic photoconductor layer (OPC) to the outer periphery of an aluminum cylinder having a diameter of 80 mm. Both ends of the photoconductor drum 1 are rotatably supported by a flange and rotated in the direction of the arrow in FIG. 1 (counterclockwise) when driving force is transferred to one end from a driving motor.

A charging roller 2 is a conductive roller obtained by forming a conductive elastic member like a roller. The roller is brought into contact with the surface of the photoconductor drum 1 and a charging bias voltage is applied to the roller from a charging bias power supply. Thereby, the surface of the photoconductor drum 1 is uniformly negatively charged.

Exposure means 3 is constituted of an LED array to whose front end a polygon mirror is set and turned on by a driving circuit in accordance with an image signal.

The development counters 4*a* to 4*d* respectively have a developing roller or the like serving as a developer bearing member adjacently set to the developer housing portion and the surface of the photoconductor drum 1. A two-component developer including toners of yellow, magenta, cyan and black of negative charging characteristic and carriers is housed in the developer housing portion as a developer. The developing roller is rotated by a driving portion and a predetermined development-bias voltage is applied to the roller by a development-bias power supply.

The intermediate transfer belt 51 is formed of an elastic endless belt having a peripheral length of 2,400 mm. The primary transfer rollers 55*a* to 55*d* contacting with the intermediate transfer belt 51 are set to the inner periphery side of the intermediate transfer belt 51 by facing four photoconductor drums 1*a* to 1*d*. The secondary transfer roller 56 contacts with the outer periphery of the intermediate transfer belt 51 at a position facing the backup roller 54.

Image Density Control

The image forming apparatus 100 of this embodiment has an image density sensor 11 as detection means for detecting a control image (reference toner image for control or patch image) formed on the intermediate transfer belt 51. The image density sensor 11 is set to a position capable of reading a control image at the outer periphery side of the intermediate transfer belt 51. In the case of this embodiment, two image density sensors 11A and 11B are set in the width direction (direction orthogonal to surface moving direction) of the intermediate transfer belt 51 at a position facing the driving roller 52. The image density sensors 11A and 11B are light-reflection-type sensors and respectively have a light emitting portion and light receiving portion. Then, light is applied to a control image (toner image for control, toner image to be detected or toner image for detection) constituted of toner formed on the intermediate transfer belt to measure the reflected light. Detection signals of the image density sensors 11A and 11B are transmitted to a CPU 110 (FIG. 4) serving as control means.

The CPU (control means) 110 performs image density control or the like in order to obtain a proper image density in accordance with a detection signal of an image density sensor. As image density control, there is preparation of a y-correction table for deciding a rule for converting an input image signal in accordance with apparatus characteristic or environment or correction control. Moreover, as image density control, there is control of image forming process conditions (development contrast and laser power) or control of toner concentration of a developer in the development counter 4 (toner replenishment control). In the case of the present invention, the control performed by using a control image is optional and it is allowed to use the control for other control other than the above described.

Thus, the image forming apparatus 100 has the control means (CPU) 110 for variably controlling the toner image forming condition of the toner image forming means (image forming portion) P in accordance with a detection result of a toner image (control image) to be detected formed on the intermediate transfer belt 51.

A control image is formed at the image forming portions Pa to Pd on the intermediate transfer belt 51 in the image forming process which is the same as the normal image formation by passing through steps of forming, developing and primary-transferring an electrostatic image (reference electrostatic image for control). The control image is formed along the moving method of the intermediate transfer belt 51 so as to be overlapped in the width direction of the intermediate transfer belt 51. Formation of the control image will be described later more specifically.

Secondary Transfer Apparatus

Figure 2:
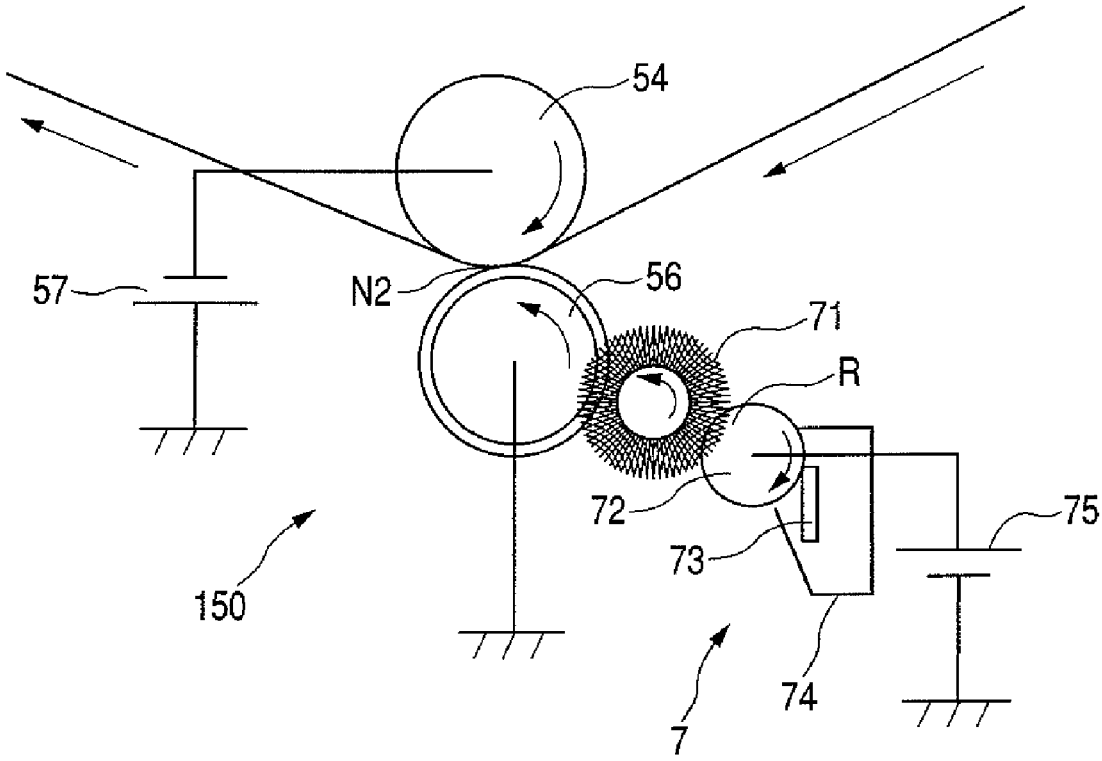
FIG. 2 is a schematic sectional view more specifically showing the secondary transfer apparatus of the image forming apparatus in FIG. 1.

FIG. 2 shows the circumference of the secondary transfer portion N2 more specifically.

In the case of this embodiment, a secondary transfer apparatus 150 serving as secondary transfer means has the backup roller 54 which rotates by contacting with the inner periphery of the intermediate transfer belt 51 in the secondary transfer portion N2. Moreover, the secondary transfer apparatus 150 has the secondary transfer roller 56 which rotates by contacting with the outer periphery of the intermediate transfer belt 51. The secondary transfer apparatus 150 further includes a secondary-transfer-member cleaner 7. The backup roller 54 and the secondary transfer roller (transfer member) 56 are mutually pressure-welded through the intermediate transfer belt 51.

The secondary transfer roller 56 transfers a toner image on the intermediate transfer belt 51 to the recording member S by rotating and contacting with a toner image to be detected (control image).

In the case of this embodiment, the secondary transfer roller 56 serving as a secondary transfer member has a layer configuration of two layers or more provided with an elastic rubber layer and coating layer (surface layer). The elastic rubber layer is constituted of an expanded layer having a cell diameter of 0.05 to 1.0 mm and of carbon black dispersion. The surface layer is constituted of a fluorine-resin material obtained by dispersing ion conductive polymers and having a thickness of 0.1 to 1.0 mm. In the case of this embodiment, the secondary transfer roller 56 is a rotor having an outside diameter of 24 mm. In the case of this embodiment, the secondary transfer roller 56 is electrically grounded.

By considering the conveyance property of the transfer member S, it is preferable to control the surface roughness of a surface layer at Rz (JIS ten points average roughness) to Rz>1.5 μm, and more preferable to control the surface roughness to Rz>2 μm. Moreover by considering the cleaning property, it is preferable to control the surface roughness of the surface layer in a range of Rz<20 μm, and more preferably in a range of Rz<5μm. That is, it is preferable that the secondary transfer roller 56 is constituted of an elastic member having a coating layer on the surface and the surface roughness Rz of the surface layer is 1.5 μm<Rz <20 μm, and more preferably 2 μm<Rz <5 μm. By using a roller having a coating layer on the surface and whose surface layer is uniformly roughened as the secondary transfer roller 56, it is possible to stabilize conveyance of the transfer member S.

As a fluorocarbon resin material constituting a surface layer, it is possible to use one of tetrafluoroethylene (TFE), hexafluoropropylene copolymer (FEP), perfluoroalkoxy resin (PFA) and polyvinylidene fluoride (PVDF). As ion conductive polymer used as a conductive agent, it is possible to use a polymer for connecting fourth-class ammonium base. As a polymer for connecting fourth-class ammonium base, it is possible to use various (for example, styrene) copolymers with (meta)acrylate for connecting fourth-class ammonium base to carboxyl group and copolymer of maleimide connecting with fourth-class ammonium base and metaacrylate. As the above ion conductive polymer, it is possible to use a polymer for connecting alkali metal salt of sulfonic acid included in sodium sulfonic acid such as sodium polysulfonic acid. As the above ion conductive polymer, it is possible to use a polymer for connecting at least hydrophilic unit of alkyl oxide in a branched chain, for example, polyethylene oxide. As the above ion conductive polymer, it is possible to use any one of polyethylene glycol-polyamide copolymer, polyethylene-epychlorohydrin copolymer, polyether amide imide and block-type polymer using polyether as a segment. By using an ion conductive polymer as a conductive agent, change of resistance values due to a transfer voltage is decreased compared to a case of independently using carbon black and by using a fluorocarbon resin material of low surface energy, it is possible to stably convey the transfer member S.

In the case of this embodiment, the backup roller 54 is a rotor having an outside diameter of 24 mm. Moreover, in the case of this embodiment, a voltage of −3 kV having the same polarity as the normal charging polarity of toner (negative polarity in the case of this embodiment) is applied to the backup roller 54 as a secondary transfer bias. The secondary transfer bias is output from a secondary transfer-bias power supply 57 serving as secondary transfer-bias output means and applied to the backup roller 54.

In the case of the secondary transfer apparatus 150, the secondary transfer roller 56 preferably rotates in a range of peripheral speed (surface moving speed) between 200 and 500 mm/sec. In the case of this embodiment, the roller 56 rotates at a speed of 300 m/sec. The peripheral speed of the secondary transfer roller 56 is substantially equal to the surface moving speed of the intermediate transfer belt 51. The backup roller 54 rotates at a peripheral speed almost equal to that of the secondary transfer roller 56.

The secondary transfer cleaner 7 has a fur brush 71 serving as a secondary transfer member cleaning member (collecting member) and a metallic roller (bias roller) 72 serving as a bias applying member constituting removing means. The secondary transfer cleaner 7 further includes a cleaning blade 73 serving as a scratching member and a waste toner vessel 74. The fur brush 71 collects the toner from the secondary transfer roller 54 by electrostatically adsorbing the toner. The metallic roller 72 is brought into contact with the fur brush 71 to apply a cleaning bias to the fur brush 71. The cleaning blade 73 contacts with the metallic roller 72, scratches off toner from the metallic roller 72 and collects it in the waste toner vessel 74.

Thus, the image forming apparatus 100 has the fur brush 71 serving as a collecting member for rotating while contacting with the secondary transfer roller 56 to collect a toner image to be detected (control image) attaching to the secondary transfer roller 56. Moreover, the image forming apparatus 100 has the metallic roller 72 serving as removing means for removing the toner image collected by the fur brush 71 from the fur brush 71 in a removing area R. In the case of this embodiment, a portion where the fur brush 71 contacts with the metallic roller 72 is the removing area R. Moreover, the area of the fur brush 71 contacting with the secondary transfer roller 56 is the removing area R. Then, the fur brush 71 passes through the removing area R before the portion of the fur brush 71 contacting with the secondary transfer roller 56 contacts with the secondary transfer roller 56 again.

Furthermore, the secondary transfer member cleaner 7 has a cleaning-bias power supply 75 serving as cleaning-bias output means. The cleaning-bias power supply 75 is connected to the metallic roller 72 and a bias output by the cleaning-bias power supply 75 is applied to the fur brush 71 through the metallic roller 72.

Moreover, in the case of this embodiment, the metallic roller 72 serving as voltage applying member with which the cleaning blade 73 is brought into contact is brought into contact with the roller-shaped fur brush 71 formed of a conductive member. Furthermore, a cleaning bias is applied to the metallic roller 72 from the cleaning-bias power supply 75. By applying a desired bias to the metallic roller 72, a potential difference due to the resistance value of the fur brush 71 is generated between the fur brush 71 and the metallic roller 72. The toner electrostatically adsorbed by the fur brush 71 from the secondary transfer roller 56 is transferred to the metallic roller-72 side in accordance with the above potential difference. The toner transferred to the metallic roller 72 is removed by the cleaning blade 73 brought into contact with the metallic roller 72. Thereby, it is normally prevented that toner is collected in the fur brush 71.

The fur brush 71 preferably has an outside diameter of 10 to 30 mm when the brush 71 does not enter a member to be cleaned from the viewpoint of space. In the case of this embodiment, the fur brush 71 has an outside diameter of 18 mm. That is, in the case of this embodiment, the radius r of the fur brush 71 is 9 mm when it does not enter a member to be cleaned. Moreover, in the case of this embodiment, the length of the fur of the fur brush 71 is set to 4 mm and the entering distance to the secondary transfer roller 56 is set to 1.0 mm. Furthermore, the density of the fur of the fur brush 71 is set to 120 kF/inch$^2$ and the resistance of the fur brush 71 is set to $1\times10^6$ (Ω)

The peripheral-speed ratio α between the peripheral speed (moving speed at radius r when fur brush does not enter a member to be cleaned) V1 of the fur brush 71 and the peripheral speed V2 of the secondary transfer roller 56 is shown by the following expression.

α=|peripheral speed (V1) of fur brush|/|peripheral speed (V2) of secondary transfer roller|

In this case, it is preferable that the peripheral speed ratio α ranges between 0 and 1 (both excluded). In the case of this embodiment, the fur brush 71 rotates in the counter direction (direction in which surface moving directions become opposite to each other at contact portion) from the rotational direction of the secondary roller 56 as shown by the arrow in FIG. 2. Then, in the case of normal setting, the fur brush 71 rotates at 20% (α=0.2) of the peripheral speed of the secondary transfer roller 56 though this will be described later in detail.

In the case of this embodiment, the outside diameter of the metallic roller 72 is 15 mm. In the case of this embodiment, the metallic roller 72 is brought into contact with the fur brush 71 at an entering distance of 1.5 mm. Moreover, in the case of this embodiment, the metallic roller 72 rotates in the counter direction (direction in which surface moving directions are opposite to each other in contact portion) from the rotational direction of the fur brush 71 as shown by the arrow in FIG. 2. Then, a bias of +800 V having a polarity reverse to the normal charging polarity of toner (negative polarity in the case of this embodiment) is applied to the metallic roller 72 from the cleaning-bias power supply 75. Thereby, as described above, a potential difference is generated between the metallic roller 72 and the fur brush 71. Then, the toner transferred from the secondary transfer roller 56 to the fur brush 71 is further transferred to the metallic-roller-72 side due to a potential difference between the metallic roller 72 and the fur brush 71. This toner is removed by the cleaning blade 73 contacting with the metallic roller 72.

In the case of this embodiment, a control image (patch image) to be detected by the image density sensor 11 is formed every sheet from the viewpoint of image stabilization. Then, in the case of this embodiment, the width of a control image (length in the direction orthogonal to surface moving direction of intermediate transfer member) W is set to 20 mm and the length of the control image (length in surface moving direction of intermediate transfer member) A is set to 50 mm. That is, a control image is formed each time at a size of width (W) of 20 mm×length (A) of 50 mm in an inter-transfer-member area (sheet) serving as an area on the intermediate transfer belt 51 between toner images to be transferred to the transfer member S while continuously forming images for a plurality of transfer members S.

It is preferable that the length of an image for control ranges between 20 and 70 mm. When the length A of a control image is less than 20 mm, the sensitivity of the image density sensor 11 for reading the control image is deteriorated and this easily becomes the cause of a read error. Moreover, when the length A of the control image exceeds 70 mm, the length of a sheet becomes necessary and the productivity of an image forming apparatus (number of sheets which can be output for 1 min) may be deteriorated. Furthermore, in the case of this embodiment, the toner concentration of a control image is 0.7 mg/cm$^2$.

Figure 3:
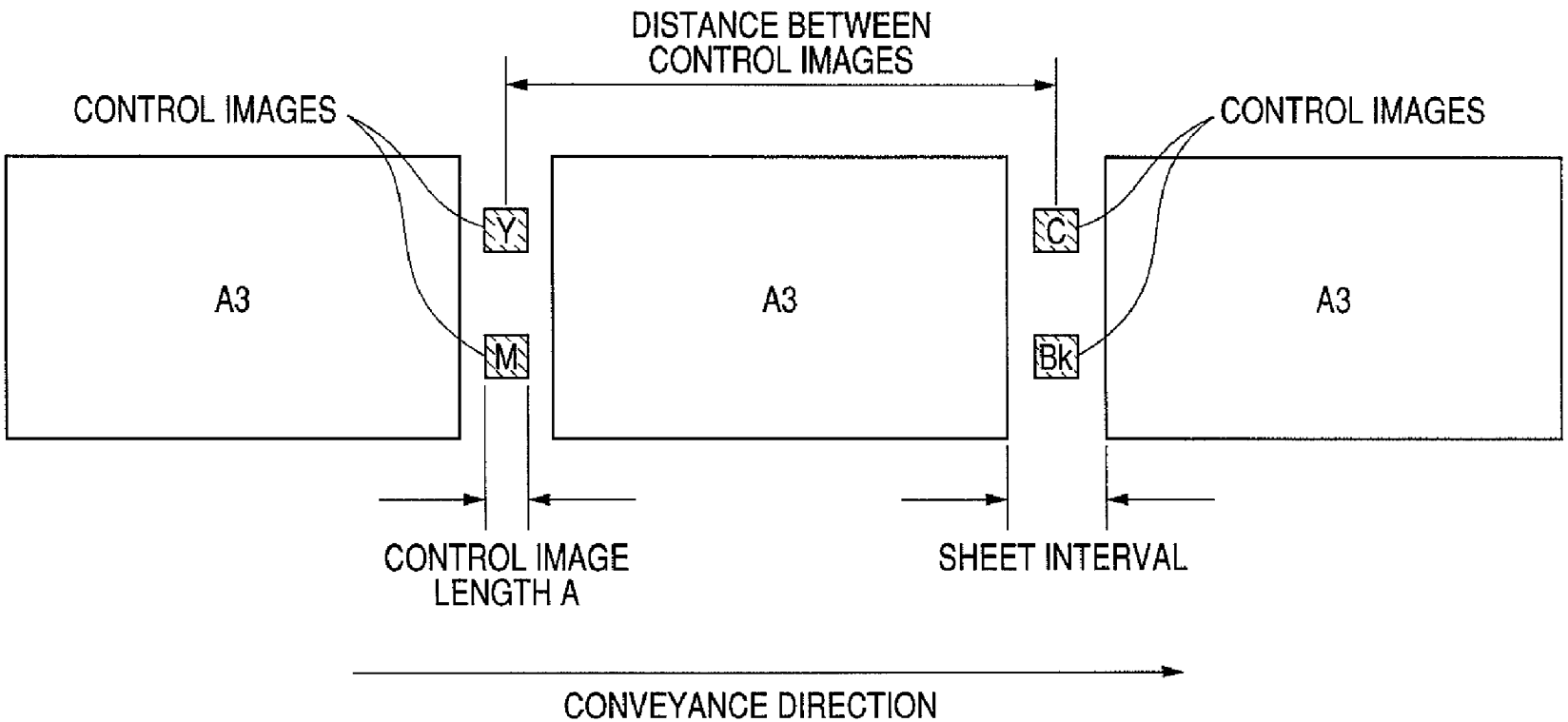
FIG. 3 is a schematic view for explaining a control image forming method.

FIG. 3 schematically shows a control image to be formed on the intermediate transfer belt 51 by using a case of using an A3-size recording member S longitudinal feed (sheet feed by adjusting longitudinal direction of recording member to conveying direction) as an example. In the case of this embodiment, a control image is formed on an each-time sheet from the viewpoint of image stability as described above. Moreover, in the case of this embodiment, the image density sensor 11 is set to two places in the direction orthogonal to the surface moving direction of the intermediate transfer belt 51. Therefore, in the case of the illustrated example, a control image is formed at two places in the direction orthogonal to the surface moving direction of the intermediate transfer belt 51 on each sheet. Furthermore, in the case of this embodiment, a sheet distance (length of sheet in surface moving direction of intermediate transfer member) is minimally set from the viewpoint of productivity of an image forming apparatus and one control image is formed in the surface moving direction of the intermediate transfer belt 51 for each sheet.

As described above, when forming a control image having much toner quantity, large toner area and high frequency and the timing at which a control image is formed on a sheet is the following, the cleaning property of the fur brush 71 is deteriorated. That is, after the toner of a control image transferred from the secondary transfer roller 56 to the fur brush 71 is cleaned by the metallic roller 72, toner is slightly left on the fur brush 71 in general. When the toner slightly left on the fur brush 71 and the toner transferred from the secondary transfer roller 56 to the fur brush 71 coincide with each other on the fur brush 71, discharge of toner from the fur brush 71 to the metallic roller-72 side is not caught up. Then, toner enters up to fur on the fur brush 71 and the original function of the fur brush 71 may be deteriorated. Therefore, this becomes a cause of imperfect cleaning causing back contamination of the transfer member S.

Moreover, a control image on a sheet is different in forming timing every conveying-directional length of the transfer member S. Therefore, when corresponding to various types of transfer members S, a control image is formed in different intervals and control images are overlapped each other on the fur brush 71. Therefore, this may raise the occurrence frequency of the above imperfect cleaning.

That is, it is one of the objects of the present invention to make it possible to clean control images formed on a sheet without overlapping them on a fur brush and prevent back contamination of a transfer member S and an image defect at the time of both-side printing. It is another object of the present invention to always achieve the preferable cleaning property of a secondary transfer member by a fur brush correspondingly to a control image on a sheet formed while forming an image on various transfer members S.

Therefore, in the case of this embodiment, when forming a control image on a plurality of sheets at predetermined intervals while continuously forming images for a plurality of transfer members S, the relation between the toner of a control image transferred to the fur brush 71 and the fur brush 71 is set as described below.

That is, a configuration is used in which the toner of a control image transferred to the fur brush 71 is not overlapped with the toner of a control image to be next formed on the fur brush 71 for at least one full circle of the fur brush 71.

That is, the fur brush 71 rotates by at least two revolutions before the toner of a control image transferred to the fur brush 71 is overlapped with the toner of a control image transferred to the secondary transfer roller 56. In this case, the fur brush 71 passes through the contact area with the metallic roller 72 at least two times. That is, the area of the fur brush 71 contacting with an area contacting with a toner image (control image) to be detected of the secondary transfer roller 56 contacts with the portion in which the secondary transfer roller 56 contacts with the toner image (control image) to be detected again. Before the secondary transfer roller 56 contacts with the toner image to be detected, the fur brush 71 passes through the toner removing area R by the metallic roller 72 at least two times.

Moreover, when the fur brush rotates at least by full circle, a control image portion formed at N-th time is set so that it is not overlapped with a control image portion formed at (N+1)-th time on the fur brush 71. According to a preferable mode, the peripheral speed ratio $\alpha$ between the secondary transfer roller 56 and the fur brush 71 is previously set so as to achieve the above configuration. Furthermore, according to another preferable mode, when the above condition is not satisfied because the conveyance-directional length of the transfer member S to be supplied for image formation is changed, the peripheral speed ratio $\alpha$ between the fur brush 71 and the secondary transfer roller 71 is changed.

That is, in the case of a secondary transfer member cleaner, when bringing the metallic roller 72 into contact with the conductive fur brush 71, the toner of a control image transferred to the conductive fur brush 71 from the secondary transfer roller 56 by an electrostatic force is further transferred to the metallic roller-72 side. However, because of a formal reason peculiar to the fur brush 71, toner enters the fur of the fur brush 71. However, it is difficult for the toner to be transferred to the metallic roller 72 from the fur brush 71 by one time. Therefore, a plurality of times are required until all the toner is transferred. Thus, even if the toner on the fur brush 71 is not transferred to the metallic roller-72 side one time, the toner is not returned to the secondary transfer roller-56 side because of the charging polarity of the toner.

However, when toner is continuously transferred to the fur brush 71, the speed of the toner to be transferred to the metallic roller-72 side does not catch up with the speed of the toner to be transferred from the secondary transfer roller 56 to the fur brush 71. Therefore, much toner is accumulated on the fur brush 71. Under this state, the time when the tone stays on the fur brush 71 is increased. Therefore, the polarity of the toner is changed and finally, it may be reversed. Then, in this case, retransfer of the toner from the fur brush 71 to the secondary transfer roller-56 side begins to cause imperfect cleaning.

Therefore, in the case of this embodiment, as described above, the toner of a control image transferred to the fur brush 71 is set so that the toner for at least full circle is not overlapped with the toner of a control image to be next formed on the fur brush 71. More specifically, the peripheral speed ratio $\alpha$ between the secondary transfer roller 56 and the fur brush 71 is set so as to achieve the above configuration. Setting of the peripheral speed ratio $\alpha$ depends on the inter-control-image distance B when forming control images at predetermined intervals for a plurality of sheets while continuously forming images or the length A of a control image.

The inter-control-image distance B when forming control images on a plurality of sheets at predetermined intervals while continuously forming images is a distance in the surface moving direction of an intermediate transfer member between equal positions in the surface moving direction of an intermediate transfer member in control images. The inter-control-image distance B is a distance including the length of the transfer member S in the conveyance direction. Therefore, the inter-control-image distance B depends on the conveyance-directional length of the transfer member S to be supplied for image formation.

In general, the productivity of the image forming apparatus 100 (number of sheets which can be output every minute) is decided for each type of the transfer member S (size or conveyance direction). The transfer member S and the inter-conveyance distance of the transfer member S, that is, inter-sheet distance are decided by the decided productivity. In the case of this embodiment, a control image is formed at the center of the decided sheet distance in the surface moving direction of the intermediate transfer belt 51. Moreover, in the case of this embodiment, a control image is formed on a plurality of sheets while continuously forming images at a given period or on every-time sheet. Therefore, the inter-control-image distance B is decided.

Then, the peripheral speed ratio $\alpha$ between the secondary transfer roller 56 and fur brush 71 for satisfying the above condition is obtained from the following expression (1) or (2) in accordance with the inter-control-image distance B, length A of a control image and radius r of the fur brush 71.

$$0<\alpha<2\pi r/B \quad (1)$$

or, $$2\pi r/(B-A)<\alpha<1 \quad (2)$$

Therefore, the peripheral speed ratio α is typically set so as to satisfy the above expression 1 in accordance with the conveyance-directional length of the transfer member S to be supplied for image formation.

Thereby, it is possible to make uniform the quantity of the toner deposited on the fur brush 71. Moreover, a state is kept in which the speed at which toner is transferred from the fur brush 71 to the metallic roller-72 side is higher than the speed in which toner is transferred from the secondary transfer roller 56 to the fur brush-71 side. Therefore, it is possible to always maintain a preferable cleaning characteristic.

Furthermore, when forming control images at predetermined intervals for a plurality of sheets while continuously forming images, as described above, the interval B between control images formed on sheets is changed every type of transfer member S (size or conveyance direction). Therefore, when the type of the transfer member S to be supplied for continuous image formation is changed, the peripheral speed ratio α is changed in a range for satisfying the above expression 1 or 2 at the change timing.

In this case, means for changing the peripheral speed ratio α preferably changes the rotational speed of the fur brush 71 because it is difficult to change the rotational speed of the secondary transfer roller 56 from the viewpoint of productivity.

Thereby, even if the inter-control-image distance B is changed by the type (size or conveyance direction) of the transfer member S, it is possible to always keep a preferable cleaning characteristic without the fact that toners of control images are overlapped on the fur brush 71.

More specifically, in the case of this embodiment, the radium r of the fur brush 71 is set to 9 mm and the length A of a control image is set to 50 mm. Moreover, the peripheral speed ratio α between the fur brush 71 and the secondary transfer roller 56 is set to 0.2 in the case of normal setting.

Under the above condition, in the case where control images transferred onto the fur brush 71 are overlapped after one revolution of the fur brush 71, the lower limit value $B_{min}$ and upper limit value $B_{max}$ of the inter-control-image distance B are calculated as below in accordance with the above expressions 1 and 2;

$$B_{min}=2\pi r/\alpha=282.7 \text{ mm, and}$$

$$B_{max}=2\pi r/\alpha+A=332.7 \text{ mm}$$

That is, if the inter-control-image distance B varies within the following range expressed by (3), the toner of a control image formed at the N-th time and the toner of a control image formed at the (N+1)-th time are overlapped on the fur brush 71.

$$282.7 \text{ mm}(B_{min})<B<332.7 \text{ mm}(B_{max}) \quad (3)$$

Under the above condition, the relation between the inter-control-image distance B when changing the type (size or conveyance direction) of the transfer member S and the overlap of continuous control images formed every sheet is shown by Table 1.

TABLE 1

| Type of sheet | Size | Sheet feed direction | Inter-control-image distance B | Control image at full circle of fur brush | Experiment No. |
|---|---|---|---|---|---|
| A4 | Width 210 mm Length 297 mm | Transverse | 240 | Not overlapped | 1 |
| | | Longitude | 332 | Overlapped | 2 |
| A3 | Width 297 mm Length 420 mm | Longitude | 455 | Not overlapped | 3 |
| B4 | Width 257 mm Length 346 mm | Transverse | 292 | Overlapped | 4 |
| | | Longitude | 381 | Not overlapped | 5 |
| B5 | Width 173 mm Length 257 mm | Transverse | 208 | Not overlapped | 6 |
| | | Longitude | 292 | Overlapped | 7 |
| Letter | Width 216 mm Length 279.5 mm | Transverse | 257 | Not overlapped | 8 |
| | | Longitude | 314.5 | Overlapped | 9 |

As shown in Table 1, by using the above conditions (r=9 mm, A=50 mm, α=0.2), control images are not overlapped on the fur brush 71 while the fur brush 71 rotates a full circle and the type (size or conveyance direction) of the next transfer member S can maintain a preferable cleaning characteristic. That is, the following is used: A4-size transverse feed (sheet is fed by adjusting short-hand direction of transfer member to conveyance direction), A3-size longitudinal feed, B4-size longitudinal feed, B 5-size transverse feed or letter-size transverse feed.

However, when using transfer members S of various types (size or conveyance direction) shown in Table 1 for image formation, control images are frequently overlapped on the fur brush 71 after one revolution of the fur brush 71 in the case of the above conditions (r=9 mm, A=50 mm, and α=0.2) as shown in Table 1. Therefore, imperfect cleaning of the secondary transfer roller 56 easily occurs. The type (size or conveyance direction) of the next transfer member S has a possibility that control images are overlapped on the fur brush 71 while the fur brush 71 rotates by one revolution in accordance with the above conditions. That is, the following are used: A4-size longitudinal feed, B4-size transverse feed, B5-size longitudinal feed or letter-size longitudinal feed.

Therefore, in the case of this embodiment, when using the type (size or conveyance direction) of the transfer member S where the inter-control-image distance B is included in the range of the above expression 3, the peripheral speed ratio α which is normally set to 0.2 is changed so as to satisfy the above expressions (1) and (2). In the case of this embodiment, the peripheral speed ratio α is changed by changing the rotational speed of the fur brush 71.

That is, in the case of r=9 mm and A=50 mm, ranges in which a peripheral speed ratio can be set are shown below.

When a A4-size sheet is fed in a longitudinal direction (B=332 mm), the peripheral speed ratio α can be varied in the range of $0<\alpha<0.17$ or $0.2<\alpha<1$.

When a B4-size sheet is fed in a transverse direction (B=292 mm), the peripheral speed ratio α can be varied in the range of $0<\alpha<0.19$ or $0.23<\alpha<1$.

When a B5-size sheet is fed in a longitudinal direction (B=292 mm), the peripheral speed ratio α can be varied in the range of $0<\alpha<0.19$ or $0.23<\alpha<1$.

When a letter-size sheet is fed in a longitudinal direction (B=314.5 mm), the peripheral speed ratio α can be varied in the range of $0<\alpha<0.18$ or $0.21<\alpha<1$.

In the case of this embodiment, the peripheral speed ratio α is set to 0.16, 0.18, 0.18 and 0.17 for A4-size longitudinal feed, B4-size transverse feed, B5-size longitudinal feed and letter-size longitudinal feed, respectively.

Thereby, it is possible to realize a state in which control images are not overlapped on the fur brush 71 and preferable cleaning property can be maintained.

Table 2 shows evaluation results of back contamination levels of the transfer member S when the inter-control-image distance B varies with the type (size or conveyance direction) of the transfer member S.

TABLE 2

| Type of sheet | Size | Sheet feed direction | Control image at one circle of fur brush | Fur brush speed control | Back contamination | Peripheral speed ratio α | Experiment No. |
|---|---|---|---|---|---|---|---|
| A4 | Width 210 mm | Transverse | Not overlapped | Not used | Absent | 0.2 | 1 |
| | Length 297 mm | Longitude | Overlapped | Not used | Present | 0.2 | 2 |
| | | | | Used | Absent | 0.16 | 2-A |
| A3 | Width 297 mm | Longitude | Not overlapped | Not used | Absent | 0.2 | 3 |
| | Length 420 mm | | | | | | |
| B4 | Width 257 mm | Transverse | Overlapped | Not used | Present | 0.2 | 4 |
| | Length 346 mm | | | Used | Absent | 0.18 | 4-A |
| | | Longitude | Not overlapped | Not used | Absent | 0.2 | 5 |
| B5 | Width 173 mm | Transverse | Not overlapped | Not used | Absent | 0.2 | 6 |
| | Length 257 mm | Longitude | Overlapped | Not used | Present | 0.2 | 7 |
| | | | | Used | Absent | 0.18 | 7-A |
| Letter | Width 216 mm | Transverse | Not overlapped | Not used | Absent | 0.2 | 8 |
| | Length 297.5 mm | Longitude | Overlapped | Not used | Present | 0.2 | 9 |
| | | | | Used | Absent | 0.17 | 9-A |

As shown in Table 2, in the case of the type (size or conveyance direction) of the transfer member S in which control images are overlapped on the fur brush 71 at a peripheral speed ratio α of 0.2, when the above speed control of the fur brush 71 is not performed, a defective image occurs due to back contamination of the transfer member S (experiment Nos. 2, 4, 7 and 9).

However, when a user designates the size and conveyance direction (sheet feed direction) of the transfer member S, the peripheral speed of the fur brush 71 is designated so that a desired peripheral speed α calculated from the above expression 1 is obtained (experiment Nos. 2-A, 4-A, 7-A and 9-A). Thereby, it is possible to prevent control images from being overlapped on the fur brush 71 and prevent a defective image due to back contamination of the transfer member S from occurring.

Figure 4:
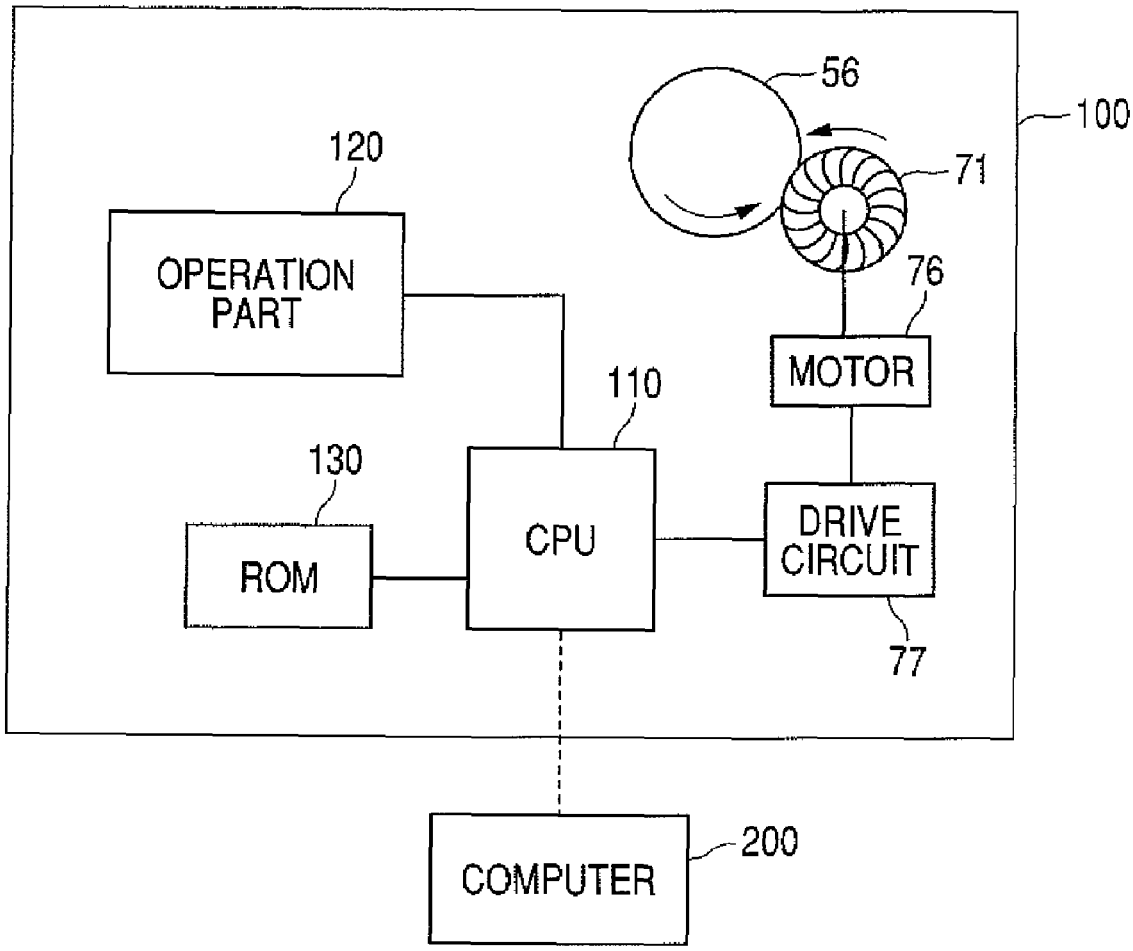
FIG. 4 is a block diagram showing a control mode of a peripheral speed ratio between a secondary transfer roller and a fur brush according to the present invention

FIG. 4 shows a schematic control block for change control of the peripheral speed ratio α of this embodiment. In the case of this embodiment, the control means (CPU) 110 set to the apparatus body 100A for generally controlling operations of the image forming apparatus 100 has a function of change means of the peripheral speed ratio α. An operating portion 120 set to the apparatus body 100A is connected to the CPU 110. A user can designate the size and conveyance direction of the transfer member S at the operating portion 120 as means for designating the length of the conveyance direction of the transfer member S. Information for rotating the fur brush 71 at a predetermined rotational speed, related to the type (size or conveyance direction) of the transfer member S is previously stored in a ROM 130 serving as storing means connected to the CPU 110. This information corresponds to a predetermined rotational speed of the fur brush 71 previously requested that the peripheral speed ratio α satisfying expression 1 or 2 is obtained depending on the type (size or conveyance direction) of the transfer member S.

When the information for designating the size and conveyance direction of the transfer member S is input from the operating portion 120 before an image is formed, the CPU 110 refers to the above information stored in the ROM 130. Then, the CPU 110 transmits a control signal corresponding to the designated type (size or conveyance direction) of the transfer member S to the driving circuit 77 of a driving motor 76 of the fur brush 71. Thereby, the driving motor 76 rotates the fur brush 71 at a set peripheral speed so that control images formed on a sheet is not overlapped on the fur brush 71 for at least one full circle and the predetermined peripheral speed ratio α is achieved.

Moreover, it is also allowed to designate the type (size or conveyance direction) of the transfer member S by the input means of an external unit 200 such as a computer communicably connected to an apparatus body A, as means for designating the length of the conveyance direction of the transfer member S, instead of or in addition to the operating portion 120 of the apparatus body A. Moreover, it is allowed to set means for detecting the type (size or conveyance direction) of the transfer member S to the apparatus body A, as means for designating the length of the conveyance direction of the transfer member S, so as to automatically designate the type (size or conveyance direction) of the transfer member S to the CPU 110.

Though it is described above that the information for designating the rotational speed of the fur brush 71 becoming the peripheral speed ratio α previously satisfying expression 1 or 2 is stored in the ROM 130, the present invention is not restricted to this case. For example, when the CPU 110 recognizes the type (size or conveyance direction) of the transfer member S used, inter-control-image distance B and length A of a control image and the like, it is allowed to properly calculate the peripheral speed ratio α and, still more rotational speed of the fur brush 71 using the information on expressions 1 and 2. The information on expressions 1 and 2 is previously stored in the ROM 130 serving as storing means.

As described above, according to this embodiment, it is possible to preferably remove the high-concentration toner to be transferred to the secondary transfer roller 56 and prevent the back contamination of the transfer member S and image defects at the time of both-side printing. Moreover, it is possible to always achieve preferable cleaning property of the secondary transfer roller 56 by the fur brush 71 correspondingly to a control image of a sheet formed while forming an image on various transfer members S. According to this embodiment, it is possible to improve the cleaning property of a secondary transfer member when a toner image for control is repeatedly formed at a predetermined interval in a plurality of inter-transfer-member areas.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2005-266124 filed on Sep. 13, 2005, which is hereby incorporated by reference herein.

What is claimed is:

1. An image forming apparatus comprising:

an image bearing member;

toner image forming means for forming a toner image on said image bearing member;

an intermediate transferring member that bears a toner image transferred from said image bearing member, said intermediate transferring member being capable of bearing a toner image for detection formed by said toner image forming means, the toner image for detection not being transferred onto a recording material;

a detecting member for detecting the toner image for detection formed on said intermediate transferring member;

control means for controlling an image forming condition of the toner image of said toner image forming means based on an output of said detecting member;

a rotatable transfer member for transferring the toner image on said intermediate transferring member to the recording material, said transfer member contacting the toner image for detection formed on said intermediate transferring member;

a rotatable collecting member that contacts said transfer member and collects toner on said transfer member; and a removing member that contacts said collecting member at a contact portion to remove the toner on said collecting member at the contact portion, wherein toner in a first contact area of said transfer member in which a first toner image for detection on said intermediate transferring member contacts said transfer member is collected in a second contact area of said collecting member which contacts the first contact area, and wherein the second contact area overlaps a contact area on said transfer member which previously contacted a second toner image for detection formed on said intermediate transferring member after the first toner image for detection on said intermediate transferring member after the second area at least twice passes through the contact portion.

2. An image forming apparatus according to claim 1, further comprising peripheral speed ratio changing means which changes a ratio $\alpha$ of a peripheral speed defined as a ratio V1/V2 of a peripheral speed V1 of a surface of said collecting member to a peripheral speed V2 of surface movement of said transfer member, wherein said peripheral speed ratio changing means changes the ratio $\alpha$ so as to satisfy a relationship in which a length of the toner image for detection in a moving direction of said intermediate transferring member is A, a distance between the toner images for detection in the moving direction of said intermediate transferring member is B and a radius of said collecting member is r, and A, B and r satisfy either of:

$$0<\alpha<2\pi r/B$$

or $$2\pi r/(B-A)<\alpha<1.$$

3. An image forming apparatus according to claim 2, wherein said peripheral speed ratio changing means changes the ratio $\alpha$ of the peripheral speed by changing the peripheral speed V1 of the surface of said collecting member.

4. An image forming apparatus according to claim 2, wherein said peripheral speed ratio changing means changes the ratio $\alpha$ of the peripheral speed when a conveyance-directional length of said transfer member is changed.

5. An image forming apparatus according to claim 1, further comprising a mode for forming a toner image for detection onto said intermediate transferring member in an interval between recording materials.

6. An image forming apparatus according to claim 1, wherein said collecting member includes a fur brush.

7. An image forming apparatus according to claim 6, wherein said removing member includes a metal roller, wherein said the metal roller removes toner on said fur brush by applying a voltage on said metal roller, the voltage having a polarity opposite to a regular charge polarity of toner.

8. An image forming apparatus according to claim 1, wherein said detecting member is positioned at a downstream side of said image bearing member and at an upstream side of said intermediate transferring member in a rotation direction of said intermediate transferring member.

* * * * *